US005193328A

United States Patent [19]

Boriani et al.

[11] Patent Number: 5,193,328

[45] Date of Patent: Mar. 16, 1993

[54] METHOD AND DEVICE FOR FOLDING PACKING BLANKS ALONG PREFORMED BEND LINES

[75] Inventors: Silvano Boriani; Antonio Gamberini, both of Bologna, Italy

[73] Assignee: G. D. Societa' per Azioni, Bologna, Italy

[21] Appl. No.: 914,420

[22] Filed: Jul. 17, 1992

[30] Foreign Application Priority Data

Jul. 19, 1991 [IT] Italy ..... B091A000266

[51] Int. Cl.[5] ..... B65B 11/08; B65B 49/08; B31B 3/44

[52] U.S. Cl. ..... 53/466; 53/228; 53/586; 493/167; 493/310

[58] Field of Search ..... 53/228, 229, 230, 231, 53/232, 399, 466, 586; 493/167, 310, 408

[56] References Cited

U.S. PATENT DOCUMENTS

| | | | |
|---|---|---|---|
| 2,883,916 | 4/1959 | Labombarde | 493/408 |
| 2,911,774 | 11/1959 | Frank et al. | 53/466 |
| 3,089,393 | 5/1963 | Pagendarm | 493/167 |
| 3,138,905 | 6/1964 | Ellinger | 53/228 |
| 3,383,825 | 5/1968 | Titchenal et al. | 53/466 |
| 3,412,525 | 11/1968 | Heinzer | 53/229 |
| 3,507,088 | 4/1970 | Mizelle et al. | 53/230 |
| 3,511,014 | 5/1970 | Kochalski | 53/466 |
| 3,585,776 | 6/1971 | Euwe | 53/230 |
| 4,493,682 | 1/1985 | Bryson et al. | 493/310 |
| 4,631,900 | 12/1986 | Mattei et al. | 53/448 |

FOREIGN PATENT DOCUMENTS

| | | | |
|---|---|---|---|
| 606424 | 11/1934 | Fed. Rep. of Germany | 53/231 |
| 2407767 | 8/1975 | Fed. Rep. of Germany | 53/466 |

*Primary Examiner*—William E. Terrell
*Attorney, Agent, or Firm*—Sandler, Greenblum & Bernstein

[57] ABSTRACT

A method and device for folding packing blanks along preformed bend lines, whereby a blank, before being positioned with its intermediate portion contacting the product, and folded in a U about the product with two lateral portions contacting the same, is engaged by two gripping and strain-relieving devices by which the two lateral portions are oscillated by a given angle about respective bend lines connecting the lateral portions to the opposite edges of the intermediate portion.

7 Claims, 2 Drawing Sheets

METHOD AND DEVICE FOR FOLDING PACKING BLANKS ALONG PREFORMED BEND LINES

BACKGROUND OF THE INVENTION

The present invention relates to a method of folding packing blanks along preformed bend lines.

The present invention is particularly suitable for use on cigarette packing and/or cartoning machines, hereinafter referred to generally as "packing machines", and to which the following description refers surely by way of example.

On cigarette packing machines, packages substantially in the form of a rectangular parallelepiped on are formed about the products, normally consisting of a group of twenty cigarettes arranged in three rows, or a group of ten packets of cigarettes arranged in two rows of five packets, from respective flat blanks, each having end lines defining an intermediate portion and two lateral portions on either side of the intermediate portion. Each lateral portion comprises a lateral panel connected to the intermediate portion along a respective bend line, hereinafter referred to as the "primary bend line"; and at least one outer portion extending outwards from a respective outer edge of the lateral panel and connected to it along a respective bend line hereinafter referred to as the "secondary bend line".

On known packing machines, each blank is folded about the product in a given number of successive stages, the first of which normally consists in positioning the blank with the intermediate portion facing a folding seat, and, by means of movable folding spindles with a bevel at the front, in folding the two lateral panels partially in a U about the respective primary bend lines and in contact with respective beveled input edges of the folding seat.

The above method involves several drawbacks, mainly due to the panels being substantially "jerked" about the respective primary bend lines, as consequence of the high output speed of modern packing machines, the extremely high operating speed of the folding spindles, and the fact that, despite the bend lines, the blanks, at least to begin with, remain extremely stiff.

A first consequence of the above drawback is that, instead of being folded, the two lateral panels may be pierced by the spindles, thus resulting in irreparable damage to the blank.

A further, and more frequent, consequence of the two panels being jerked about the bend lines is the "whiplash" effect this produces on the outer portions of each panel, and which, by virtue of at least part of the outer portions being inevitably results in fouling by drops of gum splashing off the outer portions.

Yet a further consequence of the above drawback is that, despite the spindles partially folding the lateral panels about the primary bend lines, the blank nevertheless remains stiff enough to hinder complete folding of the panels about the bend lines. As this is normally effected by inserting the product and the blank inside the folding seat, i.e. using the product itself as a reaction element, the residual rigidity of the blank may result in damage lo the product is it is inserted inside the folding seat.

SUMMARY OF THE INVENTION

It is an object of the present invention to provide a method of folding packing blanks, designed to overcome the aforementioned drawbacks.

According to he present invention, there is provided a method of folding packing blanks along preformed bend lines defining, on each blank, an intermediate portion and two lateral portions an either side of the intermediate portion, and, on each lateral portion, a lateral panel and at least one outer portion extending outwards from a respective outer edge of the respective lateral panel; said method being characterized by the fact that it comprises stages consisting in positioning the blank with the intermediate portion facing the input opening of a folding seat, and with each lateral portion in the same plane as the intermediate portion and engaged by respective gripping means; strain-relieving the blank by effecting at least one oscillation of a given angle, and preferably on either side of said plane, of each said gripping means about a respective axis coaxial with the bend line connecting the respective lateral portion to the intermediate portion; feeding the product into contact with said intermediate portion; and inserting the blank and product inside said folding seat, for finish folding said lateral portions.

The above method preferably also comprises a further stage consisting in arresting said gripping means, with the respective lateral portions folded by said angle on the opposite side of said plane to said folding seat, prior to feeding the product into contact with said intermediate portion.

According to a preferred embodiment of the above method, said oscillating angle is such as to strain-relieve each said outer portion against a respective contact element located outwards, in relation to the folding seat, of the bend line connecting said outer portion to the respective panel.

The present invention also relates to a device for folding backing blanks along preformed bend lines.

According to the present invention, there is provided a device for folding backing blanks along preformed bend lines defining, on each blank, an intermediate portion and two lateral portions on either side of the intermediate portion, and, on each lateral portion, a lateral panel and at least one outer portion extending outwards from a respective outer edge of the respective lateral panel; said device being characterized by the fact that it comprises a tubular folding seat having an input opening of substantially the same shape and size as said intermediate portion; two gripping means located on either side of the folding seat, and each engaged by a respective lateral portion of the blank when positioned with the intermediate portion facing said opening and in the same plane as the respective lateral portions; each said gripping means being to mounted as to oscillate by a given angle, preferably on either side of said plane, about a respective axis coaxial with the bend line connecting the respective lateral portion to the intermediate portion; and actuating means being provided for feeding the product into contact with said intermediate portion, and inserting the blank and the product inside the folding seat, for finish folding said lateral portions.

For each said outer portion, the above device preferably comprises a contact element located outwards, in relation to the folding seat, of the bend line connecting said outer portion to the respective said panel.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
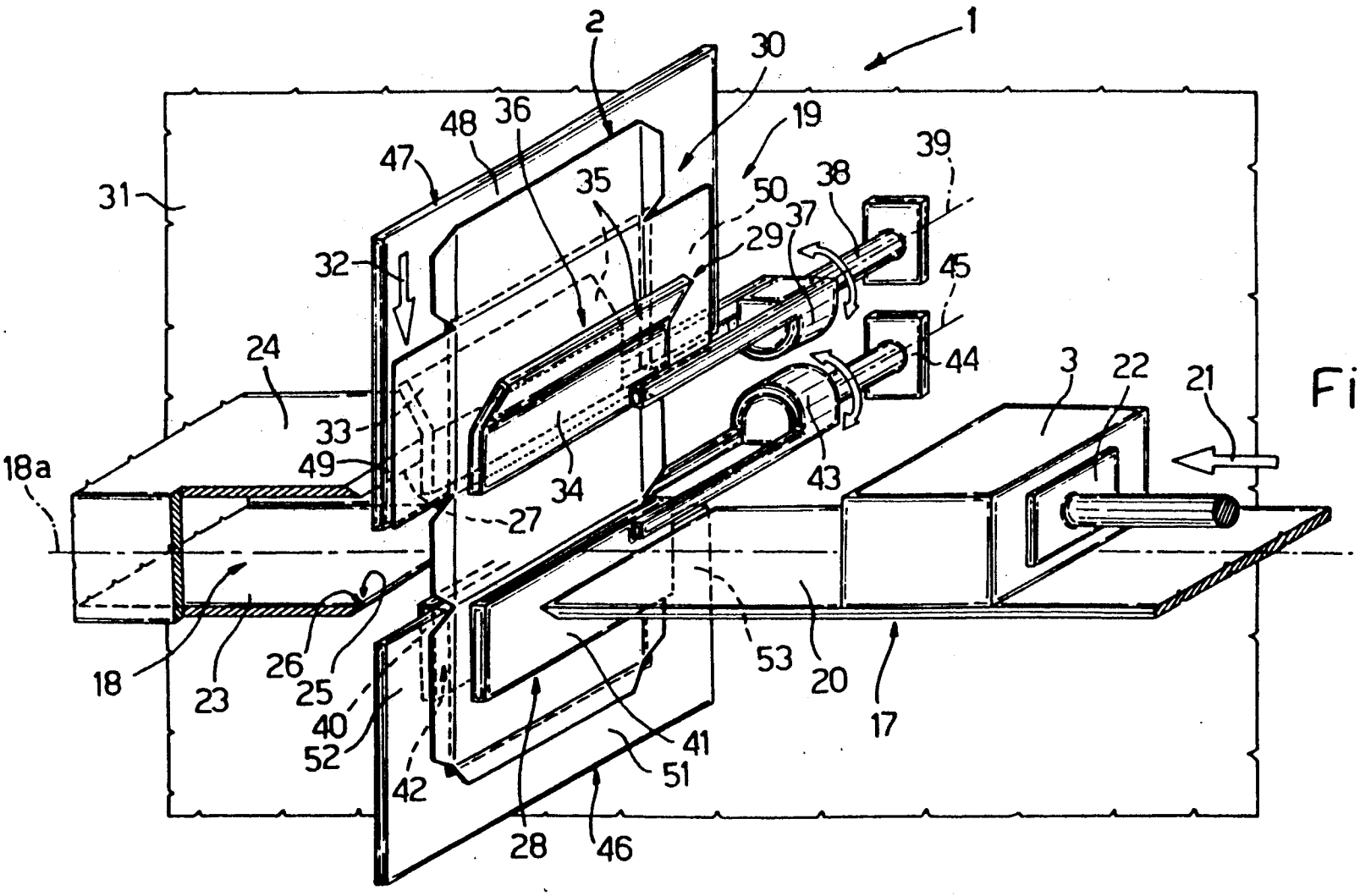
FIG. 1 shows a schematic view in perspective, with parts removed for clarity, of a preferred embodiment of the folding device according to the present invention.

Number 1 in FIG. 1 indicates a device for folding blanks 2 from which to form a package (not shown), substantially in the form of a rectangular parallelepipedon, about a product 3 consisting, in the example shown, of a number of packets of cigarettes (not shown).

Figure 2:
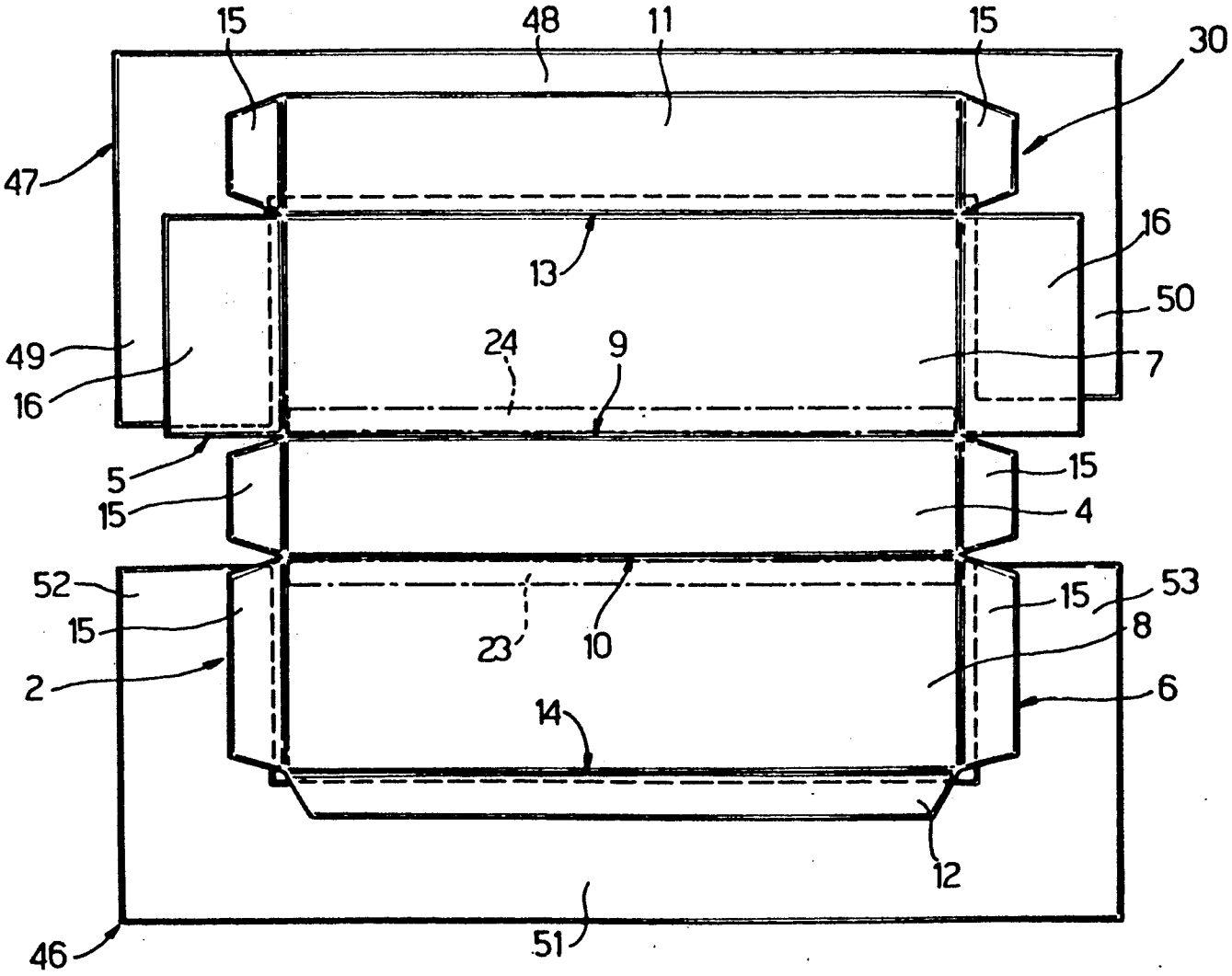
FIG. 2 shows a front view of a detail in FIG. 1.

As shown more clearly in FIG. 2, blank 2 comprises an intermediate longitudinal portion 4 constituting a first smaller lateral wall of said package (not shown): and two lateral longitudinal portions 5 and 6 on either size of intermediate portion 4. Each portion 5, 6 comprises a respective panel 7, 8 connected to intermediate portion 4 along a respective longitudinal primary bend line 9, 10, and constituting a larger lateral wall of said package; and an outer portion 11, 12 extending outwards from a respective outer edge of respective panel 7, 8, and connected to respective panel 7, 8 along a respective longitudinal secondary bend line 13, 14.

More specifically, outer portion 11 of panel 7 constitutes a second smaller lateral wall of the package; and outer portion 12 of panel 8 a longitudinal tab, which is the inner surface of outer portion 11 of panel 7.

At each longitudinal end, intermediate portion 4, outer portion 11 and panel 8 also present a foldable tab 15, which is gummed to the inner surface of a respective substantially rectangular tab 16 extending from a corresponding longitudinal end of panel 7.

As shown in FIG. 1, blanks 2 as described above and products 3 are fed successively to device 1, which comprises a conveyor 17 for products 3; a tubular folding conduit 18; and a strain-relieving unit 19 between conveyor 17 and conduit 18, for strain-relieving blanks 2 along said bend lines.

Conveyor 17 comprises a plate 20 parallel to the longitudinal axis 18*a* of conduit 18, and along which products 3 are fed successively to conduit 18, in direction 21 parallel to axis 18*a*, by an actuating means comprising a pusher 22 moving back and forth to and from circuit 18 in direction 21.

Conduit 18 comprises two walls 23 and 24 parallel to each other and to axis 18*a*, and of which wall 23 is coplanar with plate 20; and an input opening 25 defined, among other things, by respective end edges 26 and 27 of walls 23 and 24, any of substantially the same shape and size as intermediate portion 4. Opening 25 is located at such a distance from the end of conveyor 17 as to permit the assembly of strain-relieving unit 19 between conveyor 17 and conduit 18.

Unit 19 comprises two gripping devices 28 and 29 located on either side of conduit 18 and facing respective edges 26 and 27.

Gripping devices 28 and 29 are aligned along a plane 30 along which blanks 2 are fed to device 1, and which extends perpendicularly to axis 18*a* and to a plate 31 supporting plate 20 and walls 23 and 24, and intersects the path of products 3 in direction 21 at the gap between the output end of plate 20 and input opening 25 of conduit 18.

At the end of its travel along plane 30 and in vertical direction 32 perpendicular to direction 21, each blank 2 is arrested by a known stop device (not shown) in the folding position shown in FIG. 1, wherein intermediate portion 4 is arranged facing opening 25, with primary bend lines 9 and 10 coplanar with the facing surfaces of respective walls 24 and 23, and with lateral portions 5 and 6 respectively engaged by gripping devices 29 and 28.

Gripping device 29, located upstream from device 28 in relation to traveling direction 32, comprises two substantially rectangular plates 33 and 34 having, on the opposite side to that facing device 28, respective inclined lead-in portions 35 to an opening 36 defined by plated 33 and 34 and only slightly thicker than blank 2. Plates 33 and 34 are arranged facing each other on either side of and parallel to plane 30, and are connected by a U-shaped bracket 37 integral with a powered shaft 38 perpendicular to plate 31. Shaft 38 is supported on plate 31 and rotated about axis 39 coplanar with wall 24, so as to oscillate device 29 and so move opening 36 through an angle, preferably of about 20°, on either side of a central idle position coincident with plane 30.

Gripping device 28, downstream from device 29 in traveling direction 32, comprises two substantially rectangular plates 40 and 41 defining an opening 42 just slightly thicker than blank 2. Plates 40 and 41 are arranged facing each other on either side of and parallel to plane 30, and are connected by a U-shaped bracket 43 integral with lowered shaft 44 perpendicular to plate 31. Shaft 44 is supported on plate 31 and rotated about axis 45 coplanar with wall 23, so as to oscillate device 28 by the same amount but in the opposite direction to that of device 29 by shaft 38, and so move opening 42 through an angle, preferably of about 20°, on either side of a central idle position coincident with plane 30.

Gripping devices 28 and 29 provide for oscillating and strain-relieving respective lateral portions 6 and 5 in opposite directions about respective primary bend lines 10 and 9, and only engage respective panels 8 and 7, the respective outer portions 12 and 11 of which are engaged, during said oscillation by devices 28 and 29, by further respective strain-relieving devices 46 and 47.

As shown in FIG. 2, which shows blank 2 in the folding position relative to devices 46 and 47, device 47 comprises a rectangular plate 48 parallel to plane 30 and having a lateral edge just slightly upstream, in direction 32, from secondary bend line 13; and two lateral appendixes 49 and 50 extending from the opposite lateral ends of plate 48 towards device 29. Appendixes 49 and 50 are coplanar with plate 48 and arranged facing tabs 16 of panel 7 and outwards of the operating range of device 29 as it oscillates about axis 39. Again with reference to FIG. 2, device 46 comprises a rectangular plate 51 parallel to plane 30 and having a lateral edge just slightly downstream, in direction 32, from secondary bend line 14; and two lateral appendixes 52 and 53 extending from the opposite lateral ends of plate 51 towards device 28. Appendixes 52 and 53 are coplanar with plate 51 and arranged facing tabs 15 of panel 8 and outwards of the operating range of device 28 as it oscillates about axis 45.

In actual use, products 3 are fed successively along conveyor 17, and blanks 2 successively to strain-relieving unit 19 with gripping devices 28 and 29 in the idle position. As pusher 22 feeds each product 3 towards opening 25, a blank 2 is arrested between plates 33, 34 and 40, 41 as described above.

Shafts 38 and 44 are then activated for simultaneously oscillating devices 28 and 29 on either size of plane 30 containing intermediate portion 4, and about respective axes 39 and 45, so as to directly strain-relieve blank 2 along primary bend lines 9 and 10 and, at the same time, along secondary bend lines 13 and 14 and those connecting tabs 15 to panel 8 and tabs 16 to panel 7, by virtue of lateral portions 6 and 7 engaging respective devices 46 and 47. At this point, devices 28 and 29, inclined by said oscillating angle on he opposite side of plane 30 to conduit 18, are arrested so that lateral portions 5 and 6 are inclined by 20° in relation to the original position coplanar with intermediate portion 4.

In the meantime, pusher 22 is moved forward in direction 21 to bring product 3 into contact with intermediate portion 4, and to insert product 3 and portion 4 inside conduit 18 through opening 25, during which process, portions 5 and 6 are gradually withdrawn from devices 29 and 28 and folded relatively smoothly on to product 3 by walls 24 and 23.

We claim:

1. A method of folding packing blanks (2) along reformed bend lines (9, 10, 13, 14) defining, on each blank (2), an intermediate portion (4) and two lateral portions (5, 6) on either side of the intermediate portion (4), and, on each lateral portion (5, 6), a lateral panel (7, 8) and at least one outer portion (11, 12) extending outwards from a respective outer edge of the respective lateral panel (7, 8); said method being characterized by the fact that it comprises stages consisting in positioning the blank (2) with the intermediate portion (4) facing the input opening (25) of a folding seat (18), and with each lateral portion (5, 6) in the same plane (30) as the intermediate portion (4) and engaged by respective gripping means (29, 28); strain-relieving the blank (2) by effecting at least one oscillation of a given angle of each said ripping means (28, 29) about a respective axis (45, 39) coaxial with the bend line (10, 9) connecting the respective lateral portion (6, 5) to the intermediate portion (4); feeding the product (3) into contact with said intermediate portion (4); and inserting the blank (2) and product (3) inside said folding seat (18), for finish folding said lateral portions (5, 6).

2. A method as claimed in claim 1, characterized by the fact that said oscillating angle for strain-relieving said blank (2) extends on either side of said plane (30).

3. A method as claimed in claim 1, characterized by the fact that it comprises a further stage consisting in arresting said gripping means (28, 29) so that the respective said lateral portions (6, 5) are folded by said angle, on the opposite side of said plane (30) to said folding seat (18), prior to feeding said product (3) into contact with said intermediate portion (4).

4. A method as claimed in claim 1, characterized by the fact that said oscillating angle is such as to strain-relieve each said outer portion (11, 12) against a respective contact means (47, 46) located outwards, in relation to said folding seat (18), of said bend line (13, 14) connecting said outer portion (11, 12) to said respective lateral panel (7, 8).

5. A device for folding packing blanks (2) along preformed bend lines (9, 10, 13, 14) defining, on each blank (2), an intermediate portion (4) and two lateral portions (5, 6) on either side of the intermediate portion (4), and, on each lateral portion (5, 6), a lateral panel (7, 8) and at least one Outer portion (11, 12) extending outwards from a respective outer edge of the respective lateral panel (7, 8); said device being characterized by the fact that it comprises a tubular folding seat (18) having an input opening (25) of substantially the same shape and size as said intermediate portion (4); two gripping means (28, 29) located on either side of the folding seat (18), and each engaged by a respective lateral portion (6, 5) of the blank (2) when positioned with the intermediate portion (4) facing said opening (25) and in the same plane (30) as the respective lateral portions (5, 6); each said gripping means (28, 29) being so mounted as to oscillate by a given angle, about a respective axis (45, 39) coaxial with the bend line (10, 9) connecting the respective lateral portion (6, 5) to the intermediate portion (4); and actuating means (22) being provided for feeding the product (3) into contact with said intermediate portion (4), and inserting he blank (2) and the product (3) inside the folding seat (18), for finish folding said lateral portions (5, 6).

6. A device as claimed in claim 5, characterized by the fact that said angle extends on either side of said plane (30).

7. A device as claimed in claim 5, characterized by the fact that, for each said outer portion (11, 12), it comprises respective contacting and strain-relieving means (47, 46) located outwards, in relation to said folding seat (18), of said bend line (13, 14) connecting said outer portion (11, 12) to said respective panel (7, 6).

* * * * *

UNITED STATES PATENT AND TRADEMARK OFFICE

CERTIFICATE OF CORRECTION

PATENT NO. : 5,193,328

DATED : March 16, 1993

INVENTOR(S) : S. BORIANI et al.

It is certified that error appears in the above-indentified patent and that said Letters Patent is hereby corrected as shown below:

At column 1, line 15, change "parallelepiped on" to ---parallelepipedon---.

At column 1, line 20, change "end" to ---bend---.

Column 1, line 42, insert ---a--- after "as" and before "consequence".

Column 1, line 56, insert ---gummed,--- after "being"

Column 1, line 67, change "lo" to ---to---.

At column 2, line 9, change "an" to ---on---.

At column 2, line 42, change "backing" to ---packing---.

At column 3, line 33, insert ---gummed to--- after "which is".

At column 5, line 4, change "size" to ---side---.

At column 5, line 12, change "he" to ---the---.

At column 5, lines 24-25 (claim 1, lines 1-2), change "re-formed" to ---preformed---.

At column 5, line 39 (claim 1, line 16), change "ripping" to ---gripping---.

At column 6, line 20 (claim 5, line 6), change "Outer" to ---outer---.

At column 6, line 37 (claim 5, line 23), change "he" to ---the---.

Signed and Sealed this

Twenty-fourth Day of May, 1994

Bruce Lehman

*Attest:*

BRUCE LEHMAN

*Attesting Officer*

*Commissioner of Patents and Trademarks*